US006503122B1

(12) United States Patent
Hickman et al.

(10) Patent No.: US 6,503,122 B1
(45) **Date of Patent: *Jan. 7, 2003**

(54) METHOD FOR PROVIDING AN AMUSEMENT BY DEFORMING FACIAL IMAGES

(76) Inventors: James W. Hickman, 27140 Moody Rd., Los Altos Hills, CA (US) 94022; Paul L. Hickman, 27140 Moody Rd., Los Altos Hills, CA (US) 94022

( * ) Notice: Subject to any disclaimer, the term of this patent is extended or adjusted under 35 U.S.C. 154(b) by 0 days.

This patent is subject to a terminal disclaimer.

(21) Appl. No.: 09/690,682

(22) Filed: Oct. 16, 2000

Related U.S. Application Data

(60) Continuation of application No. 08/361,590, filed on Dec. 22, 1994, now Pat. No. 6,186,859, which is a division of application No. 08/172,873, filed on Dec. 23, 1993, now Pat. No. 5,376,040.

(51) Int. Cl.[7] ..... A63H 3/00
(52) U.S. Cl. ..... 446/320; 446/339; 446/387
(58) Field of Search ..... 2/206; 446/147, 446/149, 153, 268, 304, 329, 337, 339, 385, 387, 391, 395, 320

(56) References Cited

U.S. PATENT DOCUMENTS

| | | | | |
|---|---|---|---|---|
| 942,465 A | | 12/1909 | Sauer | 446/149 |
| 1,164,816 A | * | 12/1915 | Huston | 446/151 |
| 1,532,307 A | | 4/1925 | Dover | 446/151 |
| 2,019,516 A | | 11/1935 | Weinberg | 446/100 |
| 2,184,639 A | | 12/1939 | Exline | 446/339 |
| 2,760,302 A | | 8/1956 | Cheskin | 446/387 |
| 2,932,125 A | * | 4/1960 | McAllister | |
| 3,070,920 A | | 1/1963 | Bunin | 446/367 |
| 3,237,937 A | * | 3/1966 | Hoppe | |
| 4,690,653 A | | 9/1987 | Goldberg | 446/27 |
| 4,698,927 A | | 10/1987 | Yoshiro | 40/1.6 |
| 5,162,013 A | * | 11/1992 | Von Mohr | 446/320 |
| D335,937 S | | 5/1993 | Owens | D29/110 |

* cited by examiner

*Primary Examiner*—John A. Ricci
(74) *Attorney, Agent, or Firm*—Perkins Coie LLP

(57) ABSTRACT

An amusement toy including a head having at least a partial facial image, and an elastically deformable mouth associated with the head. The mouth has an undeformed dimension in the absence of a deforming force and is capable of deforming such that a deformed dimension of the mouth is at least 20% greater than the undeformed dimension of the mouth. The deformation of the mouth of the toy alters the facial image presented by the head, making a "scary face." The removal of the force causes the mouth to return to substantially its undeformed dimension. A body of the amusement toy is preferably attached to the head such that the center of gravity of the toy is below the elastically deformable mouth. A method for providing amusement includes the steps of providing a head, applying a force to a mouth associated with the head to deform the mouth from an undeformed width to a deformed width that is at least 20% greater than the undeformed width, and subsequently removing the force from the mouth, such that the mouth returns to substantially the undeformed width. The deformation of the mouth alters the facial image of the amusement toy to make a "scary face."

20 Claims, 4 Drawing Sheets

METHOD FOR PROVIDING AN AMUSEMENT BY DEFORMING FACIAL IMAGES

This application is a Continuation of application Ser. No. 08/361,590, filed Dec. 22, 1994, now U.S. Pat. No. 6,186,859, which is a Division of application Ser. No. 08/172,873, filed Dec. 23, 1993, now U.S. Pat. No. 5,376,040.

BACKGROUND OF THE INVENTION

This invention relates generally to amusement devices for children, and more particularly to dolls and other figurines used by children for amusement purposes.

Small children, e.g., children that are 2–3 years old, often find great enjoyment in simple amusements. For example, a child may enjoy making a "scary face" to provoke a mock fear reaction from his or her parents, other cooperative adults, and sophisticated children. One way that a child can make a scary faces is to place his two forefingers in the corners of his mouth, and then widen his mouth by pulling with his fingers. When performed in the audience of a cooperative adult, e.g., a parent or grandparent, or another child, this will hopefully provide the mock fear response in the viewer, to the hilarious amusement of the child performing the "scary face."

While the making of "scary faces" can be an amusing pastime for the child, the adults involved often quickly tire of the game. It would therefore be desirable to provide a method and apparatus for extending the amusement aspects of this activity for both the child and the adult participants.

SUMMARY OF THE INVENTION

The present invention provides an amusement toy and a method for providing an amusement for small children. The device and method adds complexity to the game of "scary face", thereby allowing the child's imagination to enrich the game and prolong his or her interest in the game.

Briefly, an amusement toy of the present invention includes a toy head and an elastically deformable mouth associated with the head. The head provides, at least in part, a facial image such as eyes and a nose. The mouth is capable of being deformed by the child at least 20%, preferably 50%, and most preferably at least a 100% more than the undeformed width of the mouth. The deformation of the mouth alters the facial image of the face, so as to provide a "scary face." After the mouth is released by the child, the mouth elastically returns to its original, undeformed configuration.

A first embodiment of the present invention forms the head from an elastically deformable material. The mouth is an aperture provided through the deformable material of the head and, therefore, the mouth in this embodiment is one of the features comprising the "facial image" of the head. In the absence of a force, the mouth is preferably substantially round. As the mouth is widened by a pulling action of the forefingers of the child, the facial image is altered for the desired "scary face" result. Preferably, other features of the head, such as the eyes and eyebrows, are also altered to enhance the "scary face" effect.

A second embodiment of the present invention provides a head that is a substantially continuous, rigid support structure, where the mouth is a rubber band attached to the head. The rubber band can be stretched to elongate the mouth and thereby provide the "scary face" of the present invention.

A method for providing an amusement in accordance with the present invention includes the steps of providing a toy head displaying at least a partial facial image, applying a force to a mouth associated with the head to deform the mouth from an undeformed width to a deformed width that is at least 20% greater than the undeformed width to alter the facial image of the face to become a "scary face." After the "scary face" is made, the force is removed from the mouth, and the mouth returns to substantially its undeformed width. Preferably, the force which deforms the mouth is applied by hand, e.g., by two fingers of the child pulling at the corners of the mouth of the toy.

An advantage of the present invention is that a doll or figurine is provided that can make a "scary face" to the delight of the child. The child can observe the results of his or her manipulation of the doll or figurine, and can observe the reactions of others. The amusement toy can also by used as a general-purpose plaything along with other dolls, figurines, and action toys of the child's toy collection.

These and other advantages of the present invention will become apparent upon reading the following detailed descriptions and studying the various figures of the drawings.

DETAILED DESCRIPTION OF THE PREFERRED EMBODIMENTS

Figure 1:
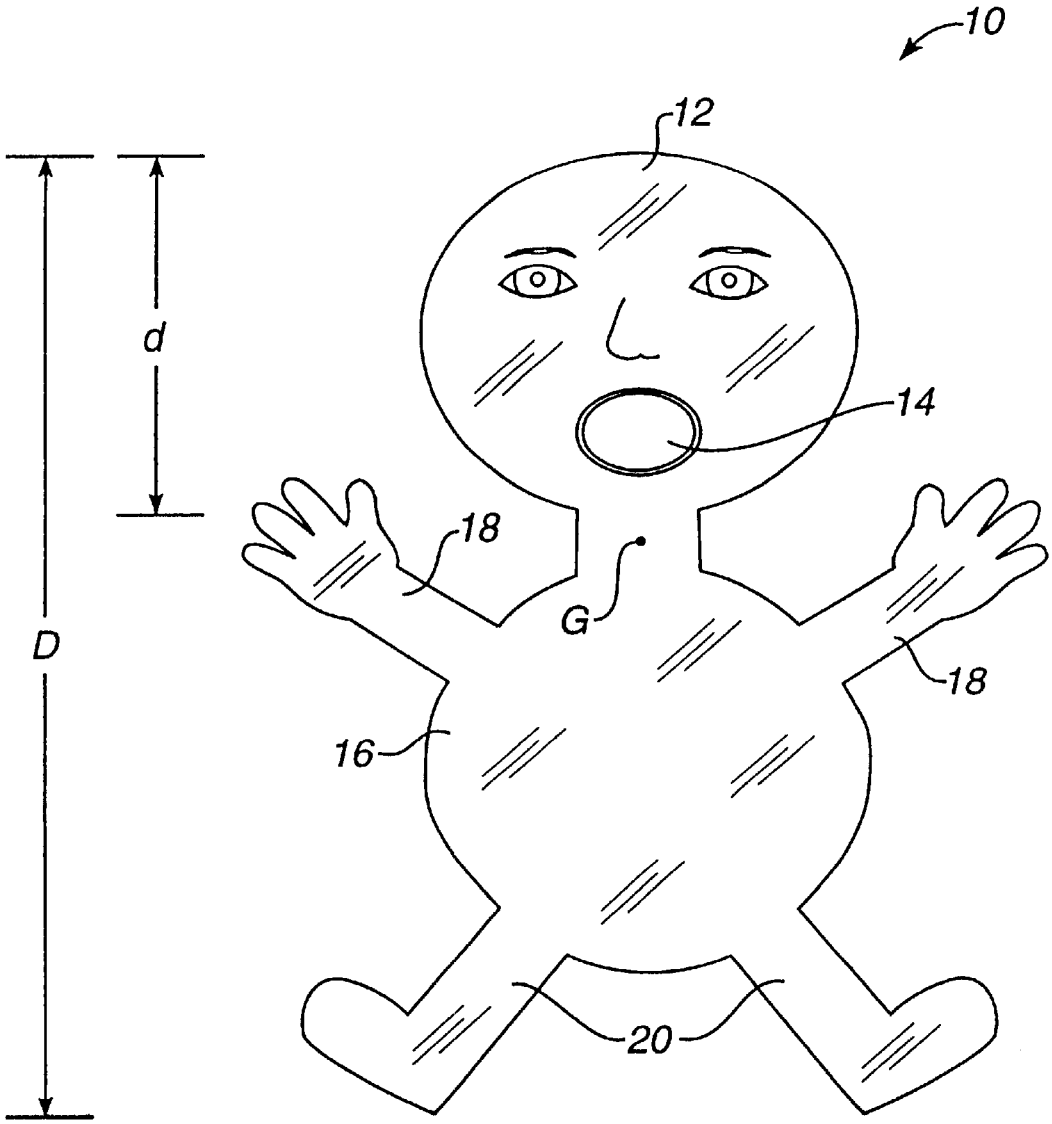
FIG. 1 is a front elevational view of an amusement toy in accordance with the present invention.

In FIG. 1, an amusement toy 10 in accordance with the present invention includes a toy head 12 and an elastically deformable toy mouth 14. The amusement toy 10 can also include a toy body 16 including arms 18 and legs 20.

The amusement toy 10 is preferably made from a sturdy, non-toxic material that can meet the rigors of use by a young child and which does not present any health hazards to the child should they, for example, partially ingest the toy. For example, the amusement 10 can be made from a natural or synthetic rubber material, or from a variety of plastic materials. In general, most stretchable materials are made from polymers. The amusement toy 10 can be made in a variety of sizes, but should not be made so small that it becomes potentially ingestible, and should not be made so large as to become cumbersome. For example, the maximum dimension 'd' of the head 12 might be in the range of 3–8 inches, while the maximum dimension 'D' of the entire amusement toy 10 might be in the range of 6–20 inches. Of course, these dimensions are only by way of example, and other dimensions may be suitable for particular applications.

The thickness of the amusement toy 10 depends upon the preferred construction of the toy. In the preferred embodiment described herein, the amusement toy 10 is substantially planar in configuration. Preferably, the thickness of the toy 10 is some fraction of an inch. For example, the material of the amusement toy 10 can be derived from a flat sheet of rubbery material that is about ⅛–¼ of an inch in thickness. Again, the thickness of the amusement toy is quite dependent upon the application, but is should be thick enough to be durable, not yet too thick as to make deformation of the mouth 14 difficult for a small child.

Alternately, amusement toy 10 can be a more rounded, three-dimensional type object where the head 12 and body 16 are roughly spherical in shape. The head 12 can be made smaller than the body 16, or vice versa. The amusement toy 10 can also be made to more closely resemble a human figurine by providing appropriate proportions to the head, torso, and limbs. However, it is believed that the best mode for practicing for the present invention includes an oversized head which allows the greatest amount of deformation of facial images in proportion to the size of the amusement toy 10 as a whole. In some embodiments of the present invention, the body 16 can be eliminated entirely.

Figure 2:
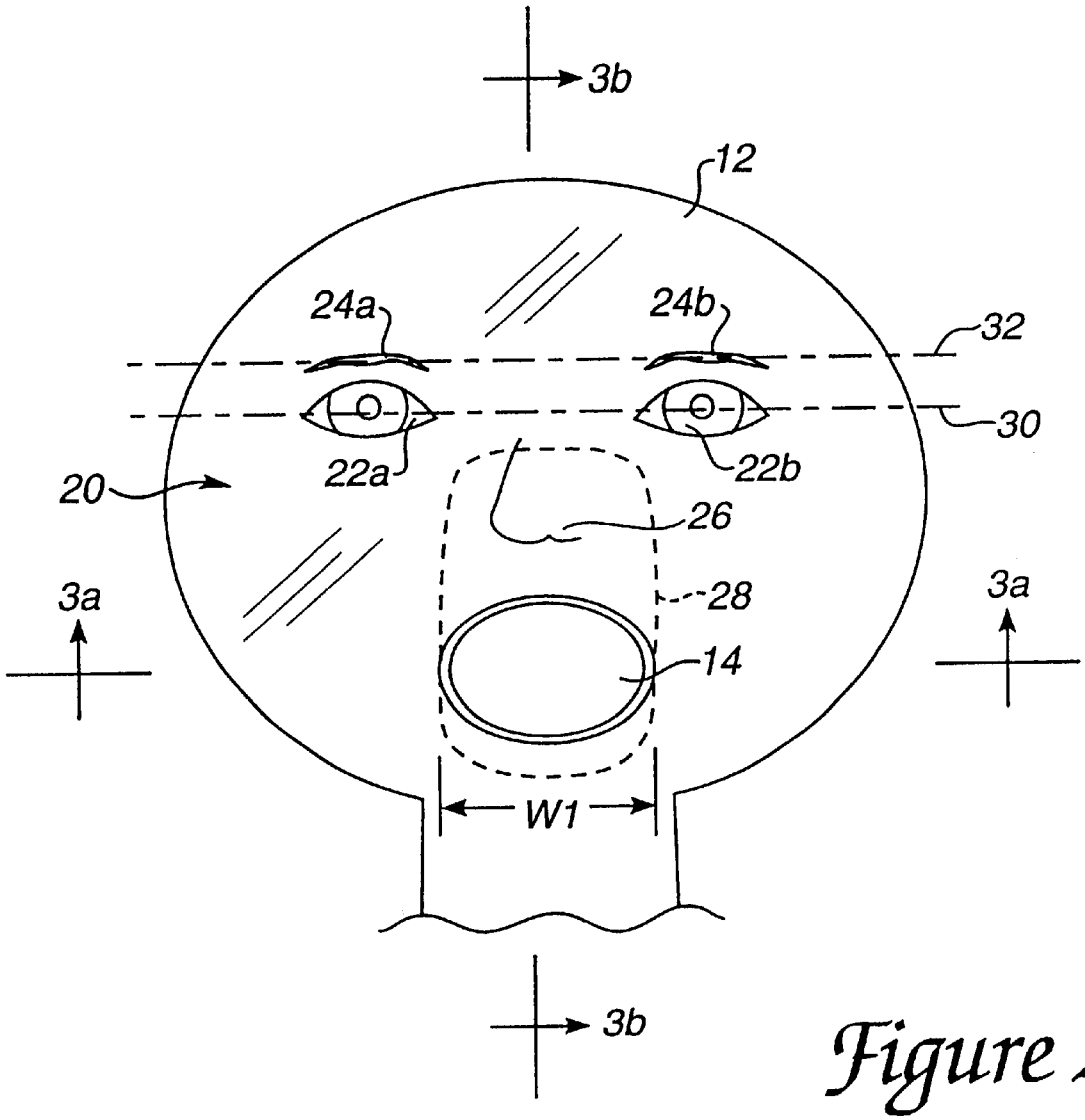
FIG. 2 is an enlarged view of the head of the amusement toy illustrated in FIG. 1.

The head 12 of the amusement toy 10 is illustrated in greater detail in FIG. 2. As previously described, the head 12 is substantially circular in configuration, although other embodiments of the present invention have heads of different shapes, e.g. oval, rectangular, triangular, etc. The head 12 provides a facial image 20 that, in this embodiment, includes "features" including a mouth 14, eyes 22*a* and 22*b*, eyebrows 24*a* and 24*b*, and nose 26. These features can be provided in a variety of manners, such as by embossing, painting, silk screening, or molding the features on the head 12. The features are preferably located in their normal relative positions on head 12, although they can also be rearranged or reoriented to increase the amusement effect. The features may or may not be exaggerated in size or shape.

In the embodiment of FIG. 2, the mouth 14 is preferably provided entirely through the head 12, i.e. it is an aperture in head 12. In other, more three-dimensional embodiments of the present invention, the mouth 14 may be provided in, but not entirely through the head 12, i.e. the mouth is a recess in the head. An area of reduced thickness 28 (shown here in broken lines) is provided in the head 12 in proximity to the mouth 14 to increase the stretchability of the mouth, and for other purposes that will be discussed subsequently. This reduced thickness area 28 is preferably provided on the back-side of the head 12 so it is not visible from the side of the head 12 displaying the facial image.

The facial image 20 illustrated in FIG. 2 is undeformed by external forces. As such, the mouth 14 has an undeformed dimension or width $w_1$. The eyes 22*a* and 22*b* are substantially horizontal and are aligned with a first axis 30. Similarly, the eyebrows 24*a* and 24*b* are substantially horizontal and are aligned with a second axis 32.

Figure 3A:
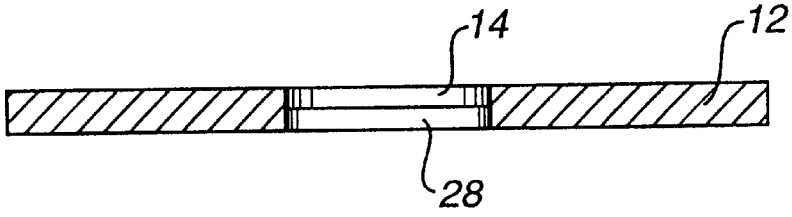
FIG. 3*a* is a cross-sectional view taken along line 3*a*–3*a* of FIG. 2.

In FIG. 3*a*, a cross-sectional view taken along line 3*a*—3*a* of FIG. 2 helps illustrate the construction of the head 12. As mentioned previously, the head 12 is preferably made from an elastically deformable material, such as natural or synthetic rubber, a highly deformable plastic material, a high stretch fabric material, etc. and is provided with a substantially circular aperture thereto which serves as mouth 14. Again, such materials are normally polymers or materials including polymers. It should be noted that the toy head 12 of the present invention is not a living, biological head, but only a non-living representation or caricature of a living, biological head. The same is true for the toy body 16 and the other portions of the toy 10. Preferably, the toy head and toy body represent or caricaturize a human head and body, but non-human (e.g. animal) or fanciful head and bodies can also be represented or charicaturized.

Figure 3B:
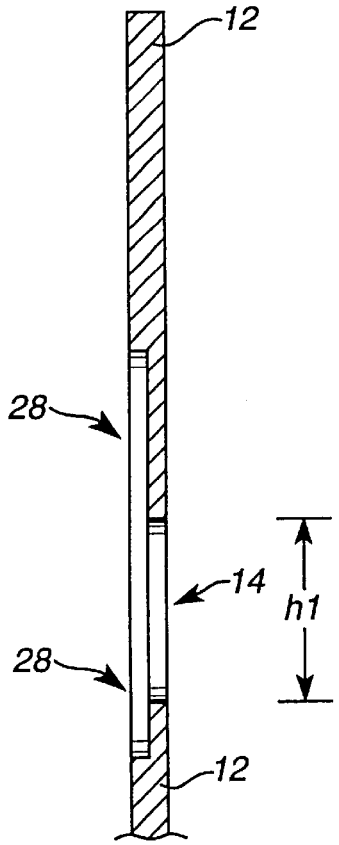
FIG. 3*b* is a cross-sectional view taken along line 3*b*–3*b* of FIG. 2.

In FIG. 3*b*, a cross-sectional view taken along line 3*b*—3*b* of FIG. 2 is shown. A mouth 14 has a height hi which, since the mouth 14 is preferably substantially circular, is about the same as width $w_1$. The reduced thickness area 28 preferably extends both above and below the mouth 14, for example, ¼–¾ of an inch.

Figure 4:
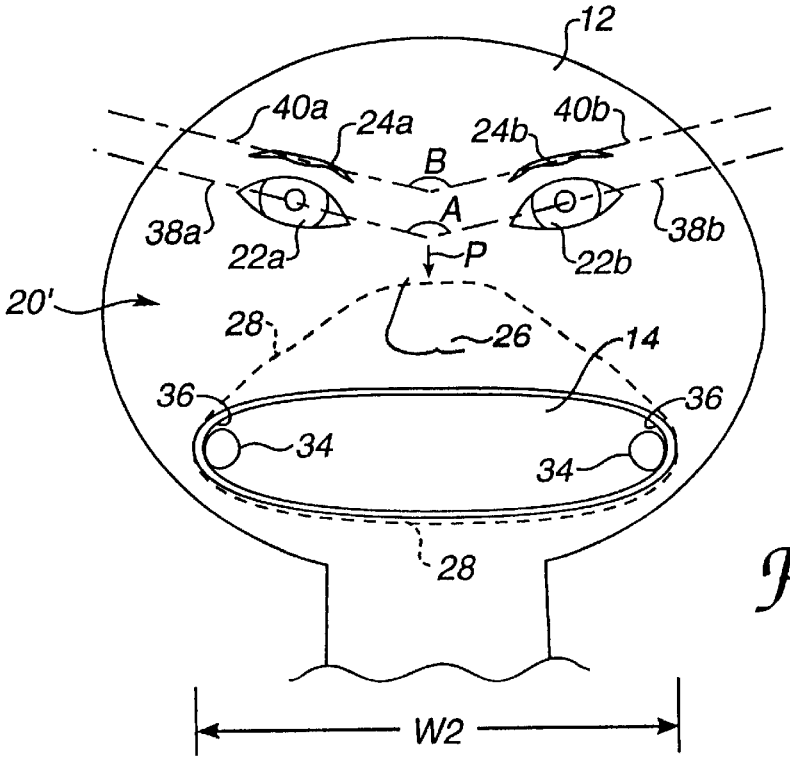
FIG. 4 is a view similar to the view of FIG. 2 with the mouth of the amusement toy being deformed.

In FIG. 4, the head 12 of the amusement toy 10 is shown with the mouth 14 being elongated to a new width $w_2$ by a pair of fingers 34. Therefore, in this preferred embodiment, a mouth 14 is deformed manually, i.e., by engaging two fingers (or "digits") of one or both hands with the corners 36 of the mouth 14 and pulling on the corners 36 with the fingers 34, resulting in the deformation of the mouth 14 to a width $w_2$ and a distorted facial image 20'. The mouth 14 should be sized to allow at least two fingers of at least one hand to engage the mouth. It should also be noted, in this preferred embodiment, that the fingers preferably engage the corners 36 of the mouth 14 from the opposite side of the head 12 that has the facial images 20', i.e. from the back-side of the head 12. This is so that the child can conveniently show the altered facial image 20' to an adult or to another child to obtain the desired reaction from the adult or child. Alternatively, in the embodiments of the present invention where the head 12 is solid and more three-dimensional in shape, the corners 36 of the mouth can be engaged from front, i.e., from the side displaying the facial image 20', which is more easily viewable by the child.

A deformed width $w_2$ of the mouth 14 is preferably at least 20% greater than the undeformed width $w_1$ of the mouth 14. This is because substantial deformation of the mouth is desirable to produce the desired effect. More preferably, the width $w_2$ is at least 50% greater than the width $w_1$, and most preferably the width $w_2$ is at least 100% greater then width $w_1$. For example, if the width $w_1$ is about 1.5 inches, it is desirable to make the material of the head 12 sufficiently resilient to allow the mouth to be stretched to at least three inches. In the illustrated embodiments of FIGS. 2 and 4, the distortion (e.g. elongation of the mouth) as illustrated is about 175%. Upon the release of the mouth, i.e. in the absence of the deforming force exerted by the fingers, the mouth 14 returns to its original, undeformed shape.

It should also be noted that the width $w_1$ and $w_2$ are preferred examples of elastic deformation of the mouth 14, but there are also other dimensions in which the mouth 14 can be elastically deformed. For example, the mouth 14 can be pulled in a vertical or in a diagonal direction. However, in this present embodiment, deformation in the horizontal direction is preferred since it is easier to pull the mouth 14 in that direction due to the reduced thickness area 28, and the "scary face" effect seems to be better enhanced in the horizontal direction.

With continuing reference to FIG. 4, when the mouth 14 is deformed as illustrated, the reduced thickness area 28 stretches and thins. Since the reduced thickness area is thinner than the surrounding material of head 12, it will stretch more easily and to a greater extent than the surrounding material. This will cause a pulling of the surrounding material in the direction of the reduced thickness area as indicated by the arrow 'P'. This pulling of the material of head 12 can cause other features of the facial image 20' to become altered, i.e., the eyes and eyebrows can be caused to slant menacingly as illustrated in FIG. 4. More specifically, the eyes 22*a* and 22*b* are caused to slant along axes 38*a* and 38*b*, respectively, and the eyebrows 24*a* and 24*b* are caused to slant along the axes 40*a* and 40*b*, respectively. The degree of the slant of the eyes 22*a* and 22*b* and of the eyebrows 24*a* and 24*b* is exaggerated here for clarity. The angle A between axis 38*a* and 38*b* and the angle B between axis 40*a* and 40*b* are obtuse angles, not too much less than 180°. For example, angles A and B can be in the range of 160°–175°. Upon the release of the deforming force, i.e. when the child stops pulling on the mouth 14 with his or her fingers, the mouth returns to substantially its undeformed shape, as illustrated in FIG. 2.

Figure 5:
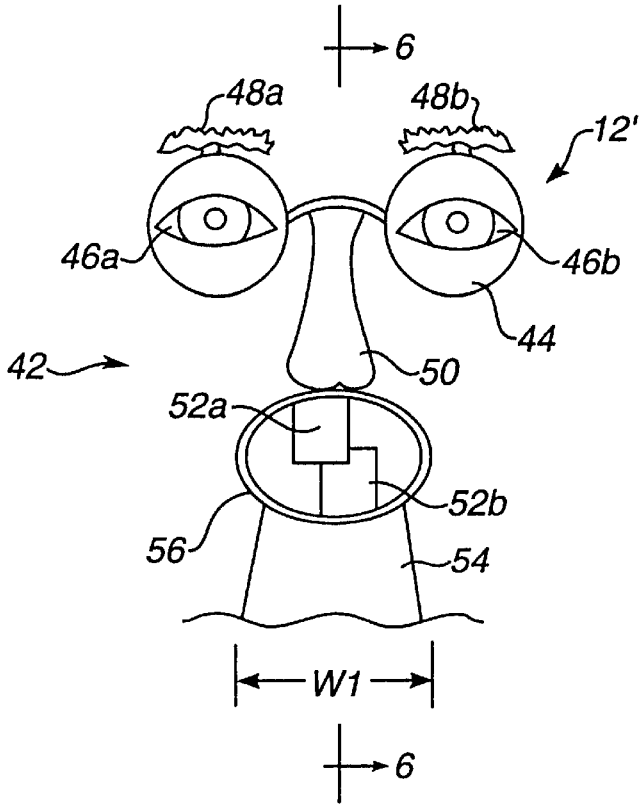
FIG. 5 is a partial, front elevational view of an alternate embodiment for the head of the amusement toy illustrated in FIG. 1.

FIG. 5 illustrates an alternate embodiment of a toy head 12' in accordance with the present invention. This head 12' can be attached to a body 16 as described previously. The head 12' has a facial image 42 and includes eyeglasses 44, a pair of eyes 46*a* and 46*b*, a pair of eyebrows 48*a* and 48*b*, a nose 50, two teeth 52*a* and 52*b*, and a neck 54. A toy mouth 56 is made from an elastically deformable band formed into a loop, and preferably comprises a sturdy, but conventional, rubber band. Alternatively, the band can be an elongated strip of rubber formed into a loop with its two ends attached together, to the head 12', or to some other member.

The head 12' of the amusement toy 10 is preferably of unitary structure and can be made from a non-deformable material such as plastic. The various features such as eyeglasses 44, eyes 46*a* and 46*b*, eyebrows 48*a* and 48*b*, nose 50, teeth 52*a* and 52*b*, and neck 54, can be injection molded from plastic to provide the desired facial image 42. In other words, the glasses 44 are not "glasses" in the real sense, but are flat, plastic members having eyes 46*a* and 46*b* molded, painted, or otherwise provided thereon. Again, it should be noted that the toy head 12' and toy body 16 of the present invention are not living, biological heads and bodies, but only a non-living representations or caricatures of a living, biological heads and bodies.

The mouth 56 has an undeformed width of approximately $w_1$. Preferably, the mouth 56 is attached both at its top and bottom to the head 12. This keeps the mouth 56 from collapsing. Alternatively, the mouth 56 can be attached to the head 12' at a single point, e.g. at the top of the loop or at the bottom of the loop.

Figure 6:
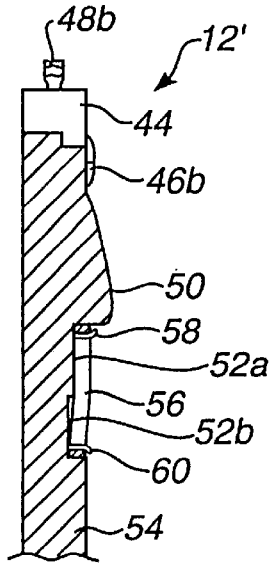
FIG. 6 is a cross-sectional view taken along lines 6—6 of FIG. 5.

A cross-sectional view of head 12' taken along line 6—6 is illustrated in FIG. 6. As illustrated in this figure, the head 12' is preferably of unitary construction, such as a single piece of injection molded plastic. The mouth 56 is shown retained near the bottom of nose 50 by a first clip 58 and is shown retained near chin 54 by a second clip 60. Preferably, the mouth 46 is a rubber band, and can be engaged and disengaged with the clips 58 and 60. This permits new rubber bands to be attached to the head 12' to replace broken rubber bands comprising mouth 56. Any suitable clip or fastener can be used to retain the mouth 56. The rubber band should be sized to allow at least two fingers of at least one hand to engage the mouth 46.

Figure 7:
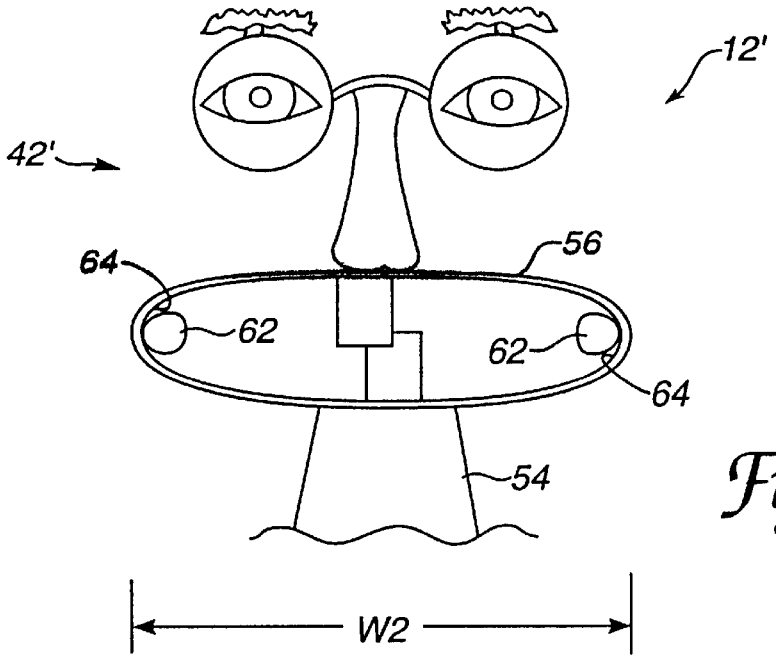
FIG. 7 is a view similar to the view of FIG. 5 with the mouth of the amusement toy being deformed.

FIG. 7 illustrates the head 12' with a pair of fingers 62 engaging the corners 64 of the mouth 56. The fingers 62 can be one hand (e.g. a thumb and forefinger) or may be on two hands (e.g. two forefingers). The mouth 56 has been elongated by the fingers to a deformed width $w_2$ which is preferably at least 20%, more preferably 50% , and most preferably at least 100% greater than the undeformed width $w_1$ of the mouth 56 as illustrated in FIG. 5. Again, the mouth can be elongated in other dimensions other than the horizontal, and one side of the mouth can be deformed without substantially deforming the other side of the mouth. Upon the release of the mouth 56, the mouth returns to its undeformed configuration as illustrated in FIG. 5. Again, the mouth 56 can be engaged either from the rear or back-side of the head 12', i.e., opposite to the facial image 42' or from the front side of the head 12'.

It is preferred in the present invention to provide a toy body 16 as illustrated in FIG. 1. This is because the mouth 14 becomes a fulcrum about which amusement toy 10 can pivot when engaged by a child's fingers. The body 16 provides a center of gravity which is below the mouth 14, thereby maintaining the head 12 in an upright position. For example, in FIG. 1, the center of gravity may be at about point G below the mouth 14. Preferably, the point G is not in the toy head at all. In alternate embodiments of the present invention, a head 12 or 12' is provided without a body, where the toy head is stabilized, for example, by moving the mouth more towards the center of the facial image, by providing a weight at a chin area, or by any other reasonable stabilizing mechanism.

In the embodiments of the present invention that were described above, the mouth of the toy is deformed by hand. In other embodiments of the present invention, levers, actuators, or other implements can be used to cause the distortion. For example, in another embodiment of the present invention, a button can be depressed on the head which, via mechanical, fluid, or other linkages, causes a distortion of the mouth.

While this invention has been described in terms of several preferred embodiments, there are alterations, permutations, and equivalents which fall within the scope of this invention. It should also be noted that there are may alternative ways of implementing both the process and apparatus of the present invention. It is therefore intended that the following appended claims be interpreted as including all such alterations, permutations, and equivalents as fall within the true spirit and scope of the present invention.

What is claimed is:

1. A method for providing an amusement comprising:

providing a deformable head having a facial image and including a mouth, two eyes, and a nose;

deforming said facial image to both move said mouth from an undeformed width to a deformed width that is at least 20% greater than said undeformed width and to cause at least one of said eyes to move, such that said facial image becomes altered; and allowing said mouth to automatically return to substantially said undeformed width in an elastic fashion.

2. A method as recited in claim 1 wherein said deformed width of said mouth is at least 50% greater than said undeformed width of said mouth.

3. A method as recited in claim 2 wherein said deformed width of said mouth is at least 100% greater than said undeformed width of said mouth.

4. A method as recited in claim 1 wherein said deforming is accomplished in conjunction with a hand.

5. A method as recited in claim 1 wherein at least one additional feature of said head in addition to said mouth and at least one of said eyes is affected by said deforming of said facial image.

6. A method as recited in claim 1 wherein said eyes are slanted in response to said deforming of said facial image.

7. A method for providing an amusement comprising:

providing a facial image including at least two eyes, a mouth in a first configuration, and a nose located generally between said eyes and said mouth, wherein said mouth is deformable with respect to said first configuration, and wherein said eyes are capable of moving with respect to said facial image;

causing said facial image to deform in response to a deforming movement initiated by at least two digits of a hand such that said mouth can be elongated in width at least 20% and at least one of said eyes moves with respect to said facial image in response to said deforming movement initiated by said at least two digits; and allowing said mouth of said facial image to automatically return to about said first configuration by a releasing movement initiated by at least one of said at least two digits.

8. A method for providing an amusement comprising:

providing a facial image including at least two eyes, a mouth in a first configuration, and a nose located generally between said eyes and said mouth, wherein said mouth is deformable with respect to said first configuration, and wherein said eyes are capable of moving with respect to said facial image;

causing said facial image to deform in response to a deforming movement initiated by at least two digits of a hand such that said mouth and at least one of said eyes moves with respect to said facial image in response to said deforming movement initiated by said at least two digits; and allowing said mouth of said facial image to automatically return to about said first configuration by a releasing movement initiated by at least one of said at least two digits;

wherein said facial image is provided on a subtantially flat surface.

9. A method as recited in claim 8 wherein said facial image is exaggerated with respect to a body.

10. A method as recited in claim 8 wherein said facial image further includes two eyebrows above said two eyes that can move with respect to said facial image, and wherein causing said facial image to deform in response to said at least two digits also causes a movement of said at least one of said eyebrows.

11. A method for providing an amusement comprising:

providing a facial image including at least two eyes, a nose, two ears, and a mouth, said mouth having non-closed, original configuration, wherein said mouth is alterable with respect to said original configuration, and wherein said eyes, nose, and ears are also alterable;

providing a hand with at least one digit;

engaging said facial image with said hand;

moving said hand such that both said mouth and at least one of said eyes alter with respect to said facial image in response to said movement of said hand, wherein said mouth can be elongated in width at least 20%; and releasing said mouth our the influence of said hand to automatically return said mouth to about said original configuration without additional action by a user.

12. A method for providing an amusement comprising:

providing a facial image including at least two eyes, a nose, two ears, and a mouth, said mouth having non-closed, original configuration, wherein said mouth is alterable with respect to said original configuration, and wherein said eyes, nose and ears are also alterable;

providing a hand with at least one digit;

engaging said facial image with said hand;

moving said hand such that both said mouth and at least one of said eyes alter with respect to said facial image in response to said movement of said hand; and releasing said mouth from the influence of said hand to automatically return said mouth to about said original configuration without additional action by a user;

wherein said facial image is provided on a substantially planar surface.

13. A method as recited in claim 12 wherein said facial image is oversized with respect to a body.

14. A method as recited in claim 12 wherein said nose and said ears are also alterable and are also capable of automatically returning to about an original configuration.

15. A method as recited in claim 14 wherein said mouth returns to said original configuration in an elastic fashion.

16. A method as recited in claim 12 wherein said facial image is a part of a three-dimensional image head.

17. A method as recited in claim 12 wherein both eyes are moved under the influence of the movement of said hand.

18. A method as recited in claim 17 wherein said facial image filter includes at least two eyebrows located proximate to said at least two eyes.

19. A method as recited in claim 18 wherein at least one of said eyebrows moves under the influence of the movement of said hand.

20. A device for providing an amusement which implements the method of claim 12.

* * * * *